US006565089B1

(12) United States Patent
Matos

(10) Patent No.: US 6,565,089 B1
(45) Date of Patent: May 20, 2003

(54) PUZZLES WITH DECODING LENSES AND ENCODED IMAGES

(76) Inventor: Jose R. Matos, 8108 Fleetwood Dr., Plano, TX (US) 75025

( * ) Notice: Subject to any disclaimer, the term of this patent is extended or adjusted under 35 U.S.C. 154(b) by 0 days.

(21) Appl. No.: 09/631,543

(22) Filed: Aug. 3, 2000

Related U.S. Application Data

(60) Provisional application No. 60/147,925, filed on Aug. 9, 1999.

(51) Int. Cl.[7] ..... A63F 9/10

(52) U.S. Cl. ..... 273/157 R; 273/153 S; 40/427; 359/463; 430/324

(58) Field of Search ..... 273/157 R, 153 S

(56) References Cited

U.S. PATENT DOCUMENTS 3,119,195 A * 1/1964 Braunhut
3,473,807 A * 10/1969 Leonard
3,538,632 A * 11/1970 Anderson
3,937,565 A * 2/1976 Alasia
3,969,830 A * 7/1976 Grasham
4,082,433 A * 4/1978 Appeldorn et al.
4,605,231 A * 8/1986 Richman
4,612,220 A * 9/1986 Baxter
4,799,680 A 1/1989 Weimar
4,815,742 A * 3/1989 Augustine
4,935,335 A * 6/1990 Fotland
4,943,063 A * 7/1990 Moreau
5,299,805 A 4/1994 Green
5,401,032 A * 3/1995 Barnhart et al.
D361,097 S 8/1995 Yan
5,543,964 A * 8/1996 Taylor et al.
5,568,313 A * 10/1996 Steenblik et al.
5,651,547 A * 7/1997 Rannelli
5,692,749 A 12/1997 Vogeler
5,715,316 A * 2/1998 Seenblik et al.
D392,002 S 3/1998 Harvey

* cited by examiner

*Primary Examiner*—Paul T. Sewell
*Assistant Examiner*—Nini F. Legesse
(74) *Attorney, Agent, or Firm*—Rick Matos; Innovar, L.L.C.

(57) ABSTRACT

The present invention is a picture puzzle comprising one or more combination decoding lens/encoded image portions which can form one or more assembled decoded images. The picture puzzle can also include one or more image portions that are not encoded. A wide range of puzzle constructions can be made according to the invention. Assembled decoded images can be formed from a first combination decoding lens/encoded image portion paired with either a second combination decoding lens/encoded image portion or an image portion that is not encoded.

29 Claims, 4 Drawing Sheets

PUZZLES WITH DECODING LENSES AND ENCODED IMAGES

This application claims benefit of Prov. Appl. No. 60/147,925 filed Aug. 9, 1999.

FIELD OF THE INVENTION

The present invention relates generally to puzzles, and more specifically, to puzzles comprising decoding lenses and encoded images. The puzzles form assembled decoded images from combination decoding lens/encoded image portions, and optionally unencoded image portions.

BACKGROUND OF THE INVENTION

Jigsaw picture puzzles are well known in the entertainment, amusement and toy industry. There is always a demand for new, more challenging puzzles with enhanced aesthetic appeal to provide users with more entertainment.

Jigsaw picture puzzles generally form an assembled image from a group of puzzle pieces made from a sheet-like substrate. Each of the puzzle pieces has comprised a single image portion which appears the same no matter which angle the image portion is viewed from. By assembling the image portions in a predetermined pattern, a desired assembled image is formed.

None of the prior art puzzles have employed combination decoding lens/encoded image portions. None of the known puzzles include more than one image portion per puzzle section. Accordingly, the maximum number of image portions included in any of the known puzzles is equal to the total number of puzzle sections that comprise the puzzle. Moreover, once the pieces of a prior art puzzle have been assembled, they can only form a single 2-dimensional assembled image, i.e., an image without visual depth or motion. Thus, prior art puzzles become less entertaining to a user even after just one use.

Lenticular image products are well known. These products comprise an overlying lenticular lens that decodes an underlying lenticular image. By viewing the lenticular article in different positions, a viewer will see two or more different decoded lenticular images beneath the lenticular lens. Lenticular lenses affixed to respective substrates bearing respective lens-resolvable linear-patterned encoded images are commercially available. The lines from the patterned image must be in alignment with the lenticules of the lenticular lens in order to form a readily viewable resolved image. Known lenticular lens/patterned image-bearing substrate combinations have generally met this requirement by permanently affixing the substrate directly onto the back of the lenticular lens or by directly printing the patterned image onto the back of the lenticular lens.

Such substrates in combination with lenticular lenses are disclosed in U.S. Pat. No. 5,488,452 to Goggins, U.S. Pat. No. 5,568,313 to Steenblik et al., U.S. Pat. No. 5,543,964 to Taylor et al., U.S. Pat. No. 5,461,495 to Steenblik et al., U.S. Pat. No. 4,935,335 to Fotland, U.S. Pat. No. 4,082,433 to Appledorn et al., U.S. Pat. No. 3,937,565 to Alasia, U.S. Pat. No. 3,538,632 to Anderson, and U.S. Pat. No. 3,119,195 to Braunhut, the disclosures of which are hereby incorporated by reference in their entirety.

To date, decoding, lenses have not been incorporated into a puzzle. It would be preferred to have a puzzle that has a greater number of image portions than it has of puzzle sections thereby increasing the number of assembled images that can be formed by the puzzle without increasing the number of puzzle sections in the puzzle. By incorporating combination decoding lens/encoded image portions into a puzzle, the number of assembled images that can be formed by the puzzle is significantly increased when compared to a similar puzzle not having these portions. A puzzle of this preferred construction would have improved versatility and would provide more entertainment than known puzzles. It would also be preferred to have puzzles including pieces whose observed image portion changes upon viewing from different angles, thereby significantly increasing the level of difficulty of the puzzle and providing a means by which plural 2-dimensional, true 3-dimensional or action sequence images can be formed. There is no teaching or suggestion in the art of the invention as described and claimed herein.

SUMMARY OF THE INVENTION

The present invention provides a picture puzzle having many novel and entertaining aspects and features. One aspect of the invention provides a multi-piece picture puzzle which forms two or more assembled images when the pieces are assembled. In this embodiment, the invention provides a picture puzzle comprising:

plural puzzle pieces, at least one piece of which bears one or more combination decoding lens/encoded image portions, wherein one, two or more assembled images are formed when the puzzle pieces are assembled.

Another aspect of the invention provides a multi-piece picture puzzle comprising:

plural puzzle pieces, at least one piece of which bears one or more combination decoding lens/encoded image portions, wherein the combination decoding lens/encoded image portion comprises at least two source images and two or more assembled images are formed when the puzzle pieces are assembled.

While some embodiments of the invention provide an asymmetrically shaped puzzle, other embodiments provide a symmetrically shaped puzzle. Still other embodiments of the invention provide a puzzle shaped as a circle, triangle, oval, square, rectangle, pentagon, parallelogram, hexagon, heptagon, octagon, multi-sided polygon having nine or more sides, a three- to twenty-pointed star, cross or profile of a person, place or thing.

In preferred embodiments, the puzzle pieces can be assembled correctly in more than one manner to form the two or more assembled images; the puzzle further comprises retaining means which maintain the pieces of the puzzle adjacent one another; the puzzle comprises at least two puzzle pieces; each of at least a majority of the puzzle pieces bears one or more combination decoding lens/encoded image portions; the decoding lenses are oriented differently or the same relative to one another when the puzzle is assembled; their are two or more different types of decoding lenses; each puzzle piece has an upper and lower surface and one or more of the puzzle pieces includes one or more combination decoding lens/encoded image portions on each surface; one or more puzzle pieces are edible or made from comestible materials; the puzzle pieces are flexible, semi-rigid or rigid; or different assembled images can be observed by viewing the assembled puzzle from different angles.

The assembled images can include text, graphics, colored patches, buildings, people, animals, food, toys, weapons, machinery, caricatures, fanciful figures, logos, letters, spaceships, and air, land or water borne vehicles, geometric patterns, irregular shapes, 2-dimensional images, 3-dimensional images or action sequence images, i.e. any image imaginable.

Edible materials can include, for example, decoding lens that comprise a substantially transparent candy material, a flexible or rigid material containing juice syrup or residue, a carbohydrate, a sweetener, an edible polymer, or other flavored and/or nutritious material.

Yet another aspect of the invention provides a method of preparing a picture puzzle comprising one or more combination decoding lens/encoded image portions, the method comprising the steps of:

1) providing a sheet type substrate;

2a) placing an encoded image portion on one or more sections of the substrate and superposing each of the encoded image portions with a respective decoding lens that decodes the encoded image portion to form a puzzle master; or 2b) attaching a preformed decoding lens bearing one or more encoded image portions on one of its surfaces to the substrate such that the encoded image portions are between the substrate and the lens to form a puzzle master; and 3) cutting the puzzle master into a plurality of puzzle pieces.

The method of the invention can further comprise one or more of the following steps:

a) repeating step 1) one or more times;

b) repeating step 2a) one or more times;

c) repeating step 2b) one or more times;

d) placing one or more image portions that are not encoded on the sheet or the decoding lens;

e) providing one or more additional substrates;

f) packaging the puzzle into a container;

g) preassembling the puzzle; or h) providing retaining means for the puzzle.

The method of the invention can be performed on conventional equipment already used in the printing, puzzle and/or lenticular products industries.

Another embodiment of the invention provides a method of preparing a picture puzzle comprising one or more combination decoding lens/encoded image portions, the method comprising the steps of:

1) providing a section of sheet type substrate;

2a) placing an encoded image portion on the section and superposing each of the encoded image portions with a respective decoding lens that decodes the encoded image portion to form a combination decoding lens/encoded image portion; or 2b) attaching a respective decoding lens bearing one or more encoded image portions on one of its surfaces to the section such that the encoded image portions are between the section and the decoding lens to form a combination decoding lens/encoded image portion; and 3) optionally repeating steps 2a) or 2b) one or more times to provide one or more different combination decoding lens/encoded image portions.

The decoding lens section and encoded image portion can be attached to one another in an offset manner to form an "overhanging puzzle piece" comprising a combination decoding lens/encoded image portion having a portion of the decoding lens extending beyond the edge of the encoded image portion and a portion of the encoded image portion extending beyond the edge of the decoding lens.

Accordingly, another aspect of the invention provides a puzzle comprising:

two or more overhanging puzzle pieces comprising a combination decoding lens/encoded image portion and having a decoding lens overhang extending beyond the edge of the encoded image portion and an encoded image portion overhang extending beyond the edge of the decoding lens, wherein the puzzle is assembled by placing the decoding lens overhang of a first overhanging puzzle piece over the encoded image overhang of one or more other overhanging puzzle pieces to form at least one assembled image.

This aspect of the invention can comprise overhanging puzzle pieces which can overhang, or mate with, one, two or at least three other overhanging puzzle pieces and can further comprise retaining means which keep adjacent overhanging puzzle pieces. The decoding lens overhang will preferably decode the encoded image of at least one encoded image overhang of a mating puzzle piece, and/or the encoded image of an encoded image overhang will be decodable by at least one decoding lens overhang.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

The present invention is different than known picture puzzles primarily in that it is a picture puzzle bearing at least one combination decoding lens/encoded image portion that forms an assembled image.

By "sheet type substrate" is meant an article, such as a film, paper, paperboard, cardboard, plastic, rubber, wood, luan, cloth, screen, mesh, polymer, veneer, or other article having a sheet type structure. The sheet can be a laminate, it can be of a unitary construction and it can comprise plural sheet sections that are affixed to one another. The sheet can be made of any rigid, semi-rigid, foldable or flexible material known to those of ordinary skill in the art and combinations thereof. The substrate will generally have a defined length, width, area and shape. Although the sheet can be any useful shape, shapes such as a pentagon, a circle, a square, an octagon, a triangle, a hexagon, a rectangle, an ellipse, a heptagon, a rectangle, a parallelogram, a multi-pointed star having three to twenty points, a letter of the alphabet, profile of a person, place or thing, logo, cross and a multi-sided polygon having nine to twenty sides are preferred. The periphery of the substrate can be smooth, straight, curved jagged or otherwise shaped.

Figure 1:
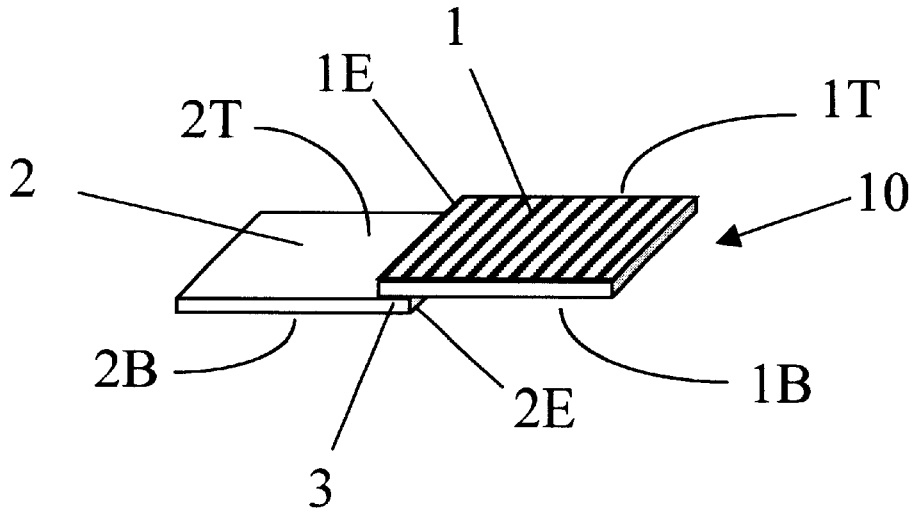
FIG. 1 is a side perspective view of an overhanging puzzle piece according to the invention.

FIG. 1 depicts an overhanging puzzle piece (10), or combination decoding lens/encoded image portion, according to one aspect of the invention. The piece (10) comprises a decoding lens (1) and a substrate (2), which bears an encoded image on its upper surface (2T) and optionally on its lower surface (2B). The decoding lens (1) is, for example, a lenticular lens bearing lenticules on its upper surface (1T). A first portion (1E) of the decoding lens (1) is attached to a second portion (2E) of the substrate (2) in overlapping arrangement (3). The portion of the decoding lens (1) that is not attached to the substrate (2) and that can superpose the upper surface of another piece (not shown) is referred to as the decoding lens overhang. The portion of the substrate (2) that is not attached to the decoding lens (1) and that can be superposed by the lower smooth surface (1B) of another piece (not shown) is referred to as the encoded image overhang.

Figure 2:
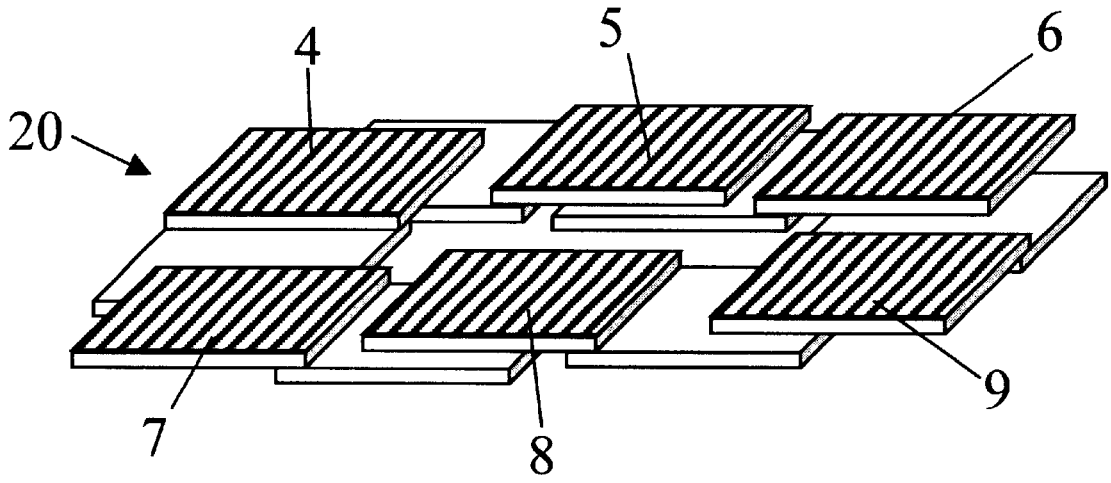
FIG. 2 is a partially exploded view of a preferred picture puzzle comprising six overhanging puzzle pieces, wherein each of the puzzle pieces bears a respective combination decoding lens/encoded image portion and an assembled image is observed from a first viewing angle.

Plural overhanging puzzle pieces, such as depicted in FIG. 1, can be assembled as depicted in FIG. 2 to form the puzzle (20). The overhanging puzzle pieces (4–9) are assembled in overlapping arrangement such that the decoding lens overhang of one piece overlaps the encoded image overhang of another piece. When the pieces are assembled properly, an assembled image can be viewed. The orientation of the lenses can vary independently of one another, and the orientation of the encoded image portions can also vary independently of one another. For example, if the decoding lenses are lenticular lenses, then the lenticular axes of one lens can be oriented in the same or a different direction than the lenticular axes of another lens. Likewise, the lenticular axes of the lenticular image sections of one lenticular image can be oriented in the same or a different direction than the lenticular axes of the lenticular image sections of another lenticular image. Further, the lenticular axes of the decoding lens and of the lenticular image segments of a single puzzle piece can be oriented in the same or a different direction.

In preferred embodiments of the invention, all of the decoding lenses of a puzzle will be oriented in the same direction; a first group of decoding lenses will be oriented in a first direction and a second group of decoding lenses will be oriented in a second direction; two or more groups of decoding lenses will be oriented in respective different directions; a majority of the decoding lens is a decoding lens overhang; a minority of the decoding lens is a decoding lens overhang.

In order to make the overhanging puzzle pieces fit together, all of the decoding lenses of the puzzle will be shaped the same or differently, or a first group of decoding lenses will be the same and two or more other groups of decoding lens will be shaped differently. The encoded image overhang and the decoding lens overhang of a single puzzle piece can be shaped the same or differently. The decoding lens overhang of a first puzzle piece can be shaped to superpose more than one encoded image overhang of the same or different shape. Likewise the encoded image overhang of a first puzzle piece can be shaped to be superposed by more than one decoding lens overhang of the same or different shape.

Figure 3A:
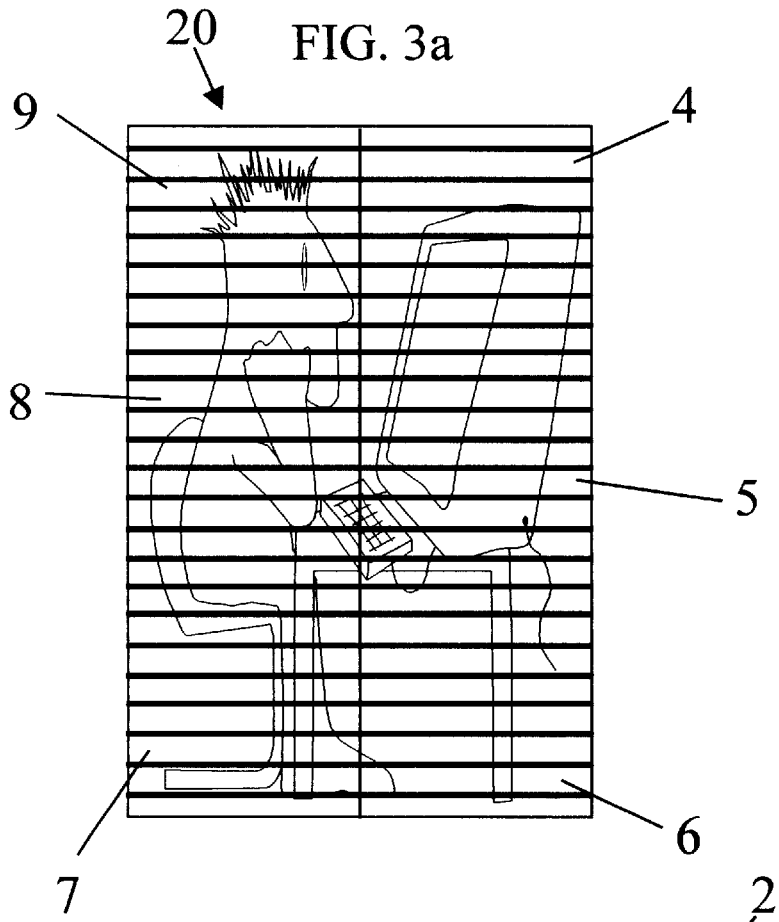
FIG. 3*a* is a top plan view of the puzzle of FIG. 2 wherein the pieces are viewed from a first viewing angle so that an assembled image is observed.
Figure 3B:
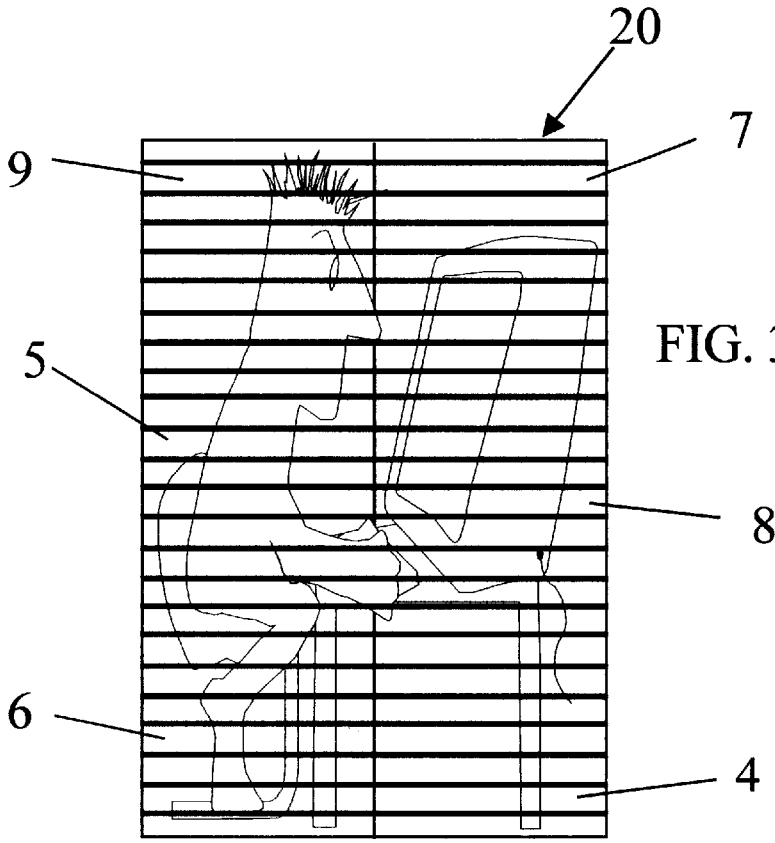
FIG. 3*b* is a top plan view the puzzle of FIG. 2 except that the pieces have been reassembled such that a different second assembled image is observed from a second viewing angle.

FIG. 3*a* depicts the assembled puzzle (20) forming a first assembled image which is observed by viewing the puzzle from a first viewing angle. The same puzzle can be viewed at a second viewing angle at which it may form a second assembled image. However, in one preferred embodiment, the puzzle (20) will not form a second assembled image unless the pieces are reassembled in a different order or pattern as depicted in FIG. 3*b*. A puzzle of this preferred construction will actually provide two or more different assembled images by assembling the puzzle pieces in different correct or proper patterns.

Although it is not depicted in the attached drawings, a puzzle can comprise one or more combination decoding lens/encoded image portions and one or more unencoded image portions which can be assembled to form one or more assembled images. In preferred embodiments, the puzzle will comprise plural combination decoding lens/encoded image portions; will comprise plural unencoded image portions; and/or will form plural assembled images.

Figure 4:
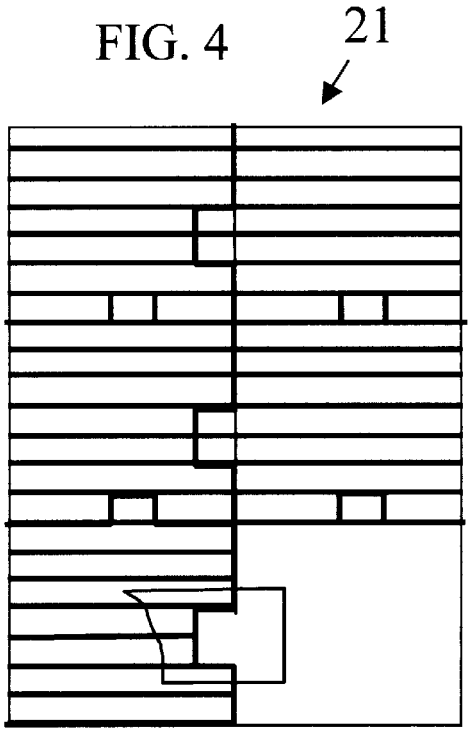
FIG. 4 is a top plan view of a jigsaw picture puzzle comprising puzzle pieces that engage one another but are not overhanging.

The puzzle can optionally include retaining means which keep the puzzle pieces adjacent one another. The retaining means can include interlocking sections of the puzzle pieces such as included in the puzzle (21) of FIG. 4 or as used in jigsaw puzzles; interconnecting sections of the puzzle pieces such as pressure fit or slide together joints; an adhesive substrate; a frame; a mounting surface; one or more magnets such as a magnetic surface for use with metal-containing puzzle pieces or a metal surface for use with magnetic puzzle pieces; an adhesive which is applied to the puzzle pieces or a surface that the puzzle is assembled on; static cling; a respositionable adhesive; a permanent adhesive; other such means used to keep objects adjacent one another; and combinations thereof.

Figure 5:
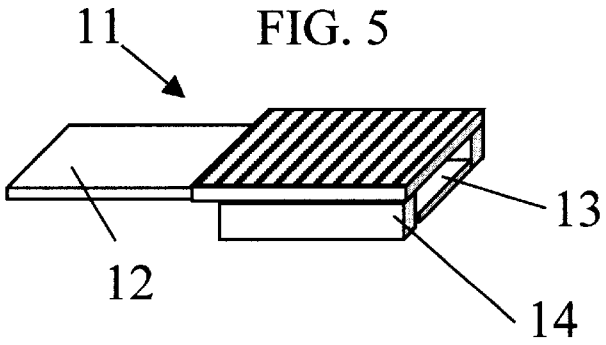
FIG. 5 is a side perspective view of an overhanging puzzle piece having a receptacle.

In another preferred embodiment, the retaining means comprises a receptable formed on either one or both an encoded image bearing substrate or a decoding lens. FIG. 5 depicts an overhanging puzzle piece (11) comprising an encoded image overhang (12) and a decoding lens overhang (14) having a receptacle (13), which is adapted to receive the encoded image overhang (12).

Figure 6:
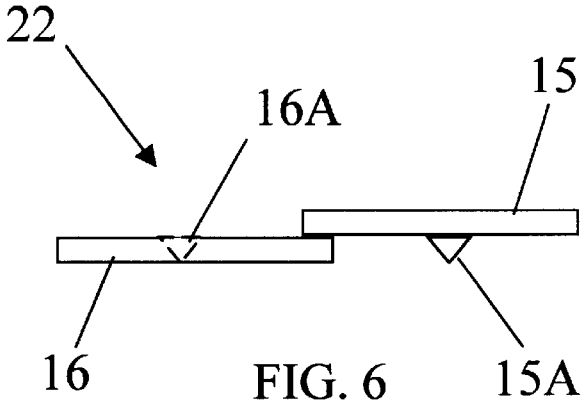
FIG. 6 is a side elevation view of an overhanging puzzle piece having a boss type projection as a male mating member and a recess as a female mating member.

In yet another preferred embodiment, the retaining means comprises mating male and female connections. FIG. 6 depicts an overhanging puzzle piece (22) comprising an encoded image overhang (16) having a recess (16A) therein and a decoding lens overhang (15) having a boss or projection (15A) therein, which is adapted to mate with the recess (16A) of another similar overhanging puzzle piece (not shown). The retaining means can also include a container of any kind.

Figure 7:
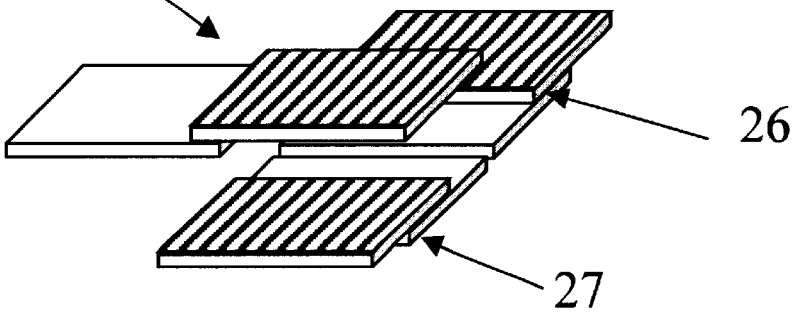
FIG. 7 is a perspective view of a first overhanging puzzle piece simultaneously superposing a second and a third overhanging puzzle piece.
Figure 8A:
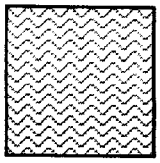
FIGS. 8*a*–8*l* are top plan views of various exemplary embodiments of the decoding lens used in the present invention.
Figure 8B:
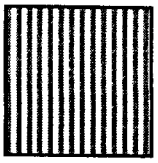
Figure 8C:
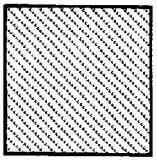
Figure 8D:
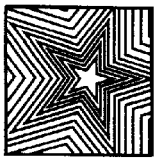
Figure 8E:
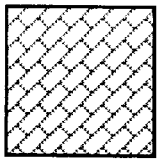
Figure 8F:
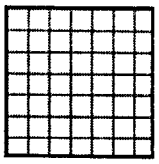
Figure 8G:
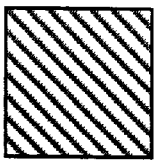
Figure 8H:
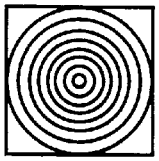
Figure 8I:
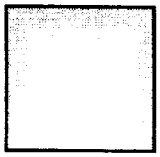
Figure 8K:
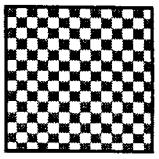
Figure 8J:
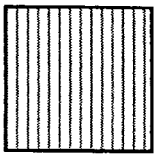
Figure 8L:
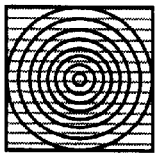

FIG. 7 depicts three overhanging puzzle pieces wherein a first piece (25) is adapted to simultaneously superpose a second (26) and a third (27) puzzle piece. Accordingly, the invention also provides overhanging puzzle pieces that are adapted to simultaneously, individually or independently superpose two or more other overhanging puzzle pieces.

Not all sections of the puzzle need to bear a combination decoding lens/encoded image portion. A first group of puzzle pieces can each comprise respective combination decoding lens/encoded image portions and a second group of puzzle pieces can each comprise respective unencoded image portions. In another preferred embodiment, the first group of combination decoding lens/encoded image portions form a 3-dimensional image or a motion sequence image.

Although not shown, the puzzle of the invention has a bottom surface which can optionally bear additional unencoded image portions and/or combination decoding lens/encoded image portions to form a two-surface puzzle.

One or more puzzles according to the invention can be packaged in a container. If two or more puzzles are included in a single container, it is preferred that the puzzle be different; and their puzzle pieces may or may not be interchangeable. The puzzle of the invention can comprise various different puzzle pieces that independently or dependently differ in shape, lens type, construction or combinations thereof. Accordingly, a multi-piece picture puzzle according to the invention can comprise at least two different groups, and preferably at least three different groups of puzzle pieces. Another embodiment of the picture puzzle comprises at least two, and preferably at least three different types of puzzle pieces. The multi-piece picture puzzle will comprise at least two, two to ten, two to one hundred, at least five hundred, at least one thousand or more puzzle pieces.

Aside from the unique feature of a picture puzzle bearing at least one combination decoding lens/encoded image portion, the puzzles according to the invention also preferably include the following features. The invention provides a picture puzzle comprising one or more puzzle pieces bearing more than one source image thereby increasing the number of images which can be borne by the puzzle without having to increase the number of puzzle pieces in the puzzle. Additionally, the invention provides a method of increasing the number of viewable assembled images which can be formed by a picture puzzle without requiring an increase in the number of puzzle pieces in the puzzle, the method comprising the step of adding to the puzzle at least one combination decoding lens/encoded image portion, wherein the combination decoding lens/encoded image portion comprises at least two source images each of which is viewable from a different respective viewing angle.

Another unique feature of the picture puzzle according to the invention is that another dimension of complexity can be added to the puzzle by including in the puzzle at least three combination decoding lens/encoded image portions, wherein:

a first one of the combination decoding lens/encoded image portions comprises at least a first source image and a second source image;

a second one of the combination decoding lens/encoded image portions comprises at least said first source image and a third source image;

a third one of the combination decoding lens/encoded image portions comprises one or more of said first source image, said second source image, said third source image, and a fourth source image.

When a puzzle having this construction is assembled, the first and second combination decoding lens/encoded image portions will together form a first assembled decoded image when viewed from a first angle but will not do so when viewed from a second angle. Further, the second and third combination decoding lens/encoded image portions will together form a first and/or third assembled decoded image when viewed from a first angle or the first and third combination decoding lens/encoded image portions will together form a first and/or second assembled decoded image when viewed from a first angle. The viewing angles can be independent of or dependent upon one another. Thus, a single pair of juxtaposed combination decoding lens/encoded image portions can form a plurality of assembled or unassembled decoded images.

As indicated above, any imaginable image or decoded image can be formed. As well, the sheet can also bear texture, entertainment and/or interaction enhancers such as smooth film, particulates, ridges, bumps, depressions, and the like; odor emitting agents such as perfumes; flavored agents such as food flavoring; and combinations thereof.

By "combination decoding lens/encoded image portion" is meant a combination of a decoding lens section superposing a respective encoded image section wherein the decoding lens is adapted to reveal or decode the encoded image. The decoded image can be affixed or printed directly onto the back or smooth surface of the decoding lens or it can be disposed between the decoding lens and a substrate affixed to the back surface of the decoding lens. When the decoding lens/encoded image portions are placed correctly side by side, an assembled image is formed.

Any known combination decoding lens/encoded image will suffice for the invention. Essentially any decoding lens will operate according to the invention. In an exemplary embodiment, the decoding lens is a lenticular lens comprising a plurality of closely spaced or adjacent, substantially equally sized, parallel, linear lenticules disposed on the front surface. The spacing, or the nodes, between the lenticules is minimal, and each lenticule has an apex. The substrate comprises a lenticular lens-resolvable linear-patterned encoded image which itself comprises a plurality of image-bearing linear encoded image sections and nulls together forming the encoded image. The encoded image generally comprises at least two source images. The linear-patterned encoded imaged is disposed on the front surface of the substrate adjacent the rear surface of the lens. The substrate is separable from the lens. When the apexes and the nodes of the lens are aligned with the image sections and the nulls of the substrate, a decoded image is formed.

Decoding lenses are commercially available and can be made of plastic, rubber, polymer, glass, silicates or combinations thereof. A suitable decoding lens will be light transmissive, transparent, translucent or semi-transparent. Such lenses can also be made flexible or rigid. Although the lenticules as depicted in the attached figures have a conical profile, they can also have a semicircular, square, blocked, rectangular, triangular or other shape. The profile can resemble any shape or combination thereof which will operate according to the invention.

Although the decoding lenses depicted in the attached figures can include substantially uniformly-sized and straight lenticules, the lenticules need not be uniform in size or straight. The lenticules can have different heights, width and curvatures. The lenticules can also be shaped as pyramids, stars, circles, ovals, triangles, squares, hemispheres, rectangles or other geometric, regular, irregular, symmetric or asymmetric shapes. FIGS. 8*a*–8*l* depict exemplary non-limiting embodiments of the decoding lens. It is only required that the construction of the lens be such that the lens can decode one or more encoded image portions.

The decoding lenses of the invention are commercially available and comprise all such lenses that can filter out color from an image, add color to an image, distort an image, filter out light, permit passage of selected light waves, selectively view portions of and/or form an assembled image of spaced-apart image portions of an image. These lenses include fresnel, colored, color filtering, light filtering, lenticular, spheric, aspheric, paraboloid, hyperboloid, concave-convex, concave-concave, convex-convex, grating, diffracting, refracting, prismatic, diffusing, focusing, magnifying, and reducing lenses and combinations thereof.

Decoding lenses that are particularly suitable for the present invention are disclosed in U.S. Pat. No. 5,461,495 to Steenblik et al., U.S. Pat. No. 4,082,433 to Appeldorn et al., U.S. Pat. No. 3,937,565 to Alasia, U.S. Pat. No. 3,119,195 to Braunhut, U.S. Pat. No. 2,514,814 to Towne, U.S. Pat. No. 3,538,632 to Anderson, U.S. Pat. No. 5,543,964 to Taylor et al., U.S. Pat. No. 4,935,335 to Fotland, U.S. Pat. No. 5,568,313 to Steenblik et al., U.S. Pat. No. 5,206,761 to Ogino, U.S. Pat. Nos. 4,597,634, 4,717,239 and 5,002,364, the disclosures of which are hereby incorporated in their entirety by reference.

The decoding lenses of the invention can be stacked or otherwise arranged to individually, additively, synergistically, or cooperatively decode an encoded or lenticular image or image portion. For example, a color filtering lens can be combined, either by attachment or by being made integral therewith, with a lenticular lens to both filter out a color from and decode the linear pattern in an encoded image disposed beneath the combination lens. The present invention includes lenses having simple and complex construction such as lenses having a single optic layer or single decoding layer as well as combination decoding lenses comprising plural individual decoding lenses that have been attached or otherwise stacked.

A picture puzzle according to the invention will preferably comprise at least two, and more preferably three or more decoding lenses which shape can be independently selected at each occurrence from any known shape. In particular embodiments, the shape of the plural decoding lenses will independently be selected from square, triangle, rectangle, parallelogram, hexagon, pentagon, heptagon, octagon, multi-sided polygon, multi-pointed star, geometric form with rounded comers, oval, ellipse, regular, irregular, symmetric, asymmetric, and combinations thereof. Generally, the shape of the decoding lens can but need not approximate the shape of a respective underlying puzzle section.

Although not required by the invention, the decoding lenses of the invention will preferably be substantially planar although they can be flat, arched or curved. The decoding lenses can also include indicia such as graphics, markings or text on either a front or rear surface thereof or within the lens itself. The graphics, markings and text included with such a lens can cooperate with the decoded image formed by the lens to form yet another image. For example, if eyes are printed on the lower surface of a decoding lens and the decoding lens forms a decoded partial facial image, the decoded facial image together with the eyes on the bottom surface of the decoding lens will together form a full facial image. In this manner, decoded images can be combined with unencoded images to form yet more images.

As used herein, the term "encoded image" means an image having one or more encoded image portions which can be decoded with a decoding lens according to the invention to form an unencoded/decoded image or unencoded/decoded image portion. An encoded image can have within it a hidden, not readily discernible, masked, colored, light activated, heat activated, water activated, water revealable, chemical agent revealable, scrambled, unassembled, scattered, patterned, invisible, visible image or combinations thereof wherein when said image is viewed through a decoding lens according to the invention, a decoded or readily discernible image is formed. The encoded image can require one or more different decoding lenses to form a decoded image. The encoded image can comprise graphics, markings, text, indicia, designs and combinations thereof. The decoded image can be an image of essentially any real or fictional person, place or thing. The encoded image can also be a part of an unencoded or readily discernible or readily viewable image, i.e., the encoded image can be hidden or masked by, embedded within or combined with a readily discernible or readily viewable image or portion thereof. A first combination decoding lens/encoded image portion can be made to form an assembled image with an image portion that is not encoded or with a second combination decoding lens/encoded image portion.

The term "lenticular lens-resolvable linear-patterned image" refers to a patterned image comprising a plurality of linear image-bearing sections which when properly viewed through a correspondingly designed lenticular decoding lens will form a decoded image or plural decoded image portions. The linear-patterned images can be but need not be substantially uniform in size. Although the linear-patterned encoded images depicted in some of the figures include straight and parallel linear image-bearing sections, the sections can be shaped as curved lines, geometrical shapes arranged linearly, and otherwise. It is only necessary that the linear-patterned encoded images be operable to cooperate with the lenticular lens to form a decoded image when the two are properly engaged. These patterned images can be Moire patterned images. Such assembled images can indicate depth, motion, stereoscopic views, other such projections or dimensions, or combinations thereof. These patterned images are particularly useful for forming different images when viewed from different angles.

A preformed combination decoding lens/encoded image portion can be prepared by outputting an encoded image portion directly onto the rear surface of a decoding lens or by outputting an encoded image portion onto a substrate which is then adhered to a decoding lens.

The sheet can also include one or more image portions that are not encoded, and these portions can be placed on the sheet either before or after placement of a combination decoding lens/encoded image portion.

The picture puzzles of the invention can be included in media such as a book, magazine, packet, newspaper, pamphlet, brochure, leaflet, flyer, booklet, boxes, packages, or pad. Accordingly, it will be necessary to assemble or prepare one or more of said picture puzzles, which are the same or different, and include them in one or more of the above media.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A multi-piece picture puzzle comprising:

plural puzzle pieces, plural ones of which bear one or more combination decoding lens/encoded image portions, wherein at least a first assembled image is formed when the puzzle pieces are assembled in a first puzzle-solving arrangement and at least a second assembled image is formed the puzzle pieces are assembled in a second different puzzle-solving arrangement.

2. The puzzle of claim 1, wherein a first group of puzzle pieces comprise respective combination decoding lens/encoded image portions and a second group of puzzle pieces comprise respective unencoded image portions.

3. The puzzle of claim 1 further comprising a retaining means.

4. The puzzle of claim 3, wherein the retaining means are selected from the group consisting of interlocking sections of the puzzle pieces; interconnecting sections of the puzzle pieces; pressure fit joints; slide together joints; an adhesive substrate; a frame; a mounting surface; one or more magnets; a magnetic surface for use with metal-containing puzzle pieces; a metal surface for use with magnetic puzzle pieces; an adhesive which is applied to the puzzle pieces; an adhesive that is applied to a surface on which the puzzle is assembled; static cling; a respositionable adhesive; a permanent adhesive; a container; one or more receptacles on the puzzle pieces; mating male and female connections; overlapping portions of puzzle pieces and combinations thereof.

5. The puzzle of claim 1, wherein two or more of the puzzle pieces are overhanging puzzle pieces, each comprising a decoding lens overhang and an encoded image overhang.

6. The puzzle of claim 5, wherein the decoding lens overhang comprises a majority of the decoding lens portion and the encoded image overhang comprises a majority of the encoded image portion.

7. The puzzle of claim 5, wherein the decoding lens overhang comprises a minority of the decoding lens portion and the encoded image overhang comprises a minority of the encoded image portion.

8. The puzzle of claim 1, wherein the puzzle comprises at least three combination decoding lens/encoded image portions, wherein:

a first one of the combination decoding lens/encoded image portions comprises at least a first source image portion and a second source image portion;

a second one of the combination decoding lens/encoded image portions comprises at least another first source image portion and a third source image portion;

a third one of the combination decoding lens/encoded image portions comprises another first source image portion, another second source image portion, another third source image portion, and/or a fourth source image portion; and said first and second combination decoding lens/encoded image portions together form a first assembled decoded image from said first source image portions when viewed from a first angle and an unassembled decoded image when viewed from a second angle.

9. The puzzle of claim 1, wherein at least one of the plural combination decoding lens/encoded image portions forms an assembled image with an unencoded image portion.

10. The puzzle of claim 1, wherein the upper and lower surfaces of two or more of the plural puzzle pieces each bears a combination decoding lens/encoded image portion or an unencoded image portion such that an assembled image can be formed on upper and lower surfaces of the puzzle.

11. The puzzle of claim 1, wherein the upper shape of the decoding lens is selected from the group consisting of a cross, pentagon, circle, square, octagon, triangle, hexagon, rectangle, ellipse, heptagon, rectangle, parallelogram, multi-pointed star having three to twenty points, letter of the alphabet, multi-sided polygon having nine to twenty sides and combinations thereof.

12. The puzzle of claim 1, wherein the puzzle comprises a material selected from the group consisting of polymer, paper, plastic, rubber, film, laminate, laminated paper, cloth, wood, metal, paper, comestible material, fiber, glass, screen, mesh, paperboard, cardboard, and a combination thereof.

13. The puzzle of claims 1, wherein two or more of the plural combination decoding lens/encoded image portions have different orientations when the puzzle is assembled.

14. The puzzle of claim 1, wherein the decoding lens of the plural combination decoding lens/encoded image portions is independently selected at each occurrence from a lens that can filter out color from an image, add color to an image, distort an image, filter out light, permit passage of selected light waves, selectively view portions of an image, form an assembled image of spaced-apart image portions of an image and combinations thereof.

15. The puzzle of claim 14, wherein the lens is independently at each occurrence one of a fresnel, colored, color filtering, fly's eye, compound, light filtering, lenticular, spheric, aspheric, paraboloid, hyperboloid, concave-convex, concave-concave, convex-convex, grating, diffracting, refracting, prismatic, diffusing, focusing, magnifying, and reducing lens and a combination thereof.

16. The puzzle of claim 1, wherein one or more parts of the puzzle are edible or made from a comestible material.

17. The puzzle of claim 1, wherein plural combination decoding lens/encoded image portion each comprise at least two source images, and at least two assembled images are formed when said puzzle is assembled.

18. A multi-piece puzzle comprising two or more overhanging puzzle pieces, each comprising a combination decoding lens/encoded image portion, a decoding lens overhang extending beyond the edge of the encoded image portion and an encoded image portion overhang extending beyond the edge of the decoding lens, wherein the puzzle is assembled by placing the decoding lens overhang of a first overhanging puzzle piece over the encoded image overhang of one or more other overhanging puzzle pieces to form at least one assembled image.

19. The puzzle of claim 18, wherein at least one overhanging puzzle piece can overhang, or mate with, at least two other overhanging puzzle pieces.

20. The puzzle of claim 18 further comprising retaining means.

21. The puzzle of claim 20, wherein the retaining means is selected from the group consisting of one or more receptacles; interlocking sections of the puzzle pieces; interconnecting sections of the puzzle pieces; pressure fit joints; slide together joints; an adhesive substrate; a frame; a mounting surface; ore or more magnets; a magnetic surface for use with metal-containing puzzle pieces; a metal surface for use with magnetic puzzle pieces; an adhesive which is applied to the puzzle pieces; an adhesive that is applied to a surface on which the puzzle is assembled; static cling; a respositionable adhesive; a permanent adhesive; a container; one or more receptacles on the puzzle pieces; mating male and female connections; overlapping portions of puzzle pieces and combinations thereof.

22. The puzzle of claim 18, wherein the decoding lenses of a puzzle are all oriented in the same direction.

23. The puzzle of claim 18, wherein a majority of the decoding lens is a decoding lens overhang and a majority of the encoded image is an encoded image overhang.

24. The puzzle of claim 18, wherein a minority of the decoding lens is a decoding lens overhang and a minority of the encoded image is an encoded image overhang.

25. The puzzle of claim 18, wherein the decoding lens overhang will decode the encoded image of at least one encoded image overhang of another puzzle piece or the encoded image of an encoded image overhang will be decodable by at least one decoding lens overhang.

26. The puzzle of claim 18, wherein the shape of the decoding lens overhang of an overhanging puzzle piece is substantially the same as the shape of a respective encoded image overhang of the same overhanging puzzle piece.

27. The puzzle of claim 18, wherein at least a first assembled image is formed when the puzzle pieces are assembled in a first manner and at least a second assembled image is formed the puzzle pieces are assembled in a second different manner.

28. The puzzle of claim 18, wherein a first group of decoding lenses are oriented in a first direction and a second group of decoding lenses are oriented in a second direction.

29. The puzzle of claim 18, wherein two or more groups of decoding lenses are oriented in respective different directions.

* * * * *